US011559750B2

(12) United States Patent
Melo

(10) Patent No.: US 11,559,750 B2
(45) Date of Patent: Jan. 24, 2023

(54) DYNAMIC PROJECTION MAPPING FOR MORPHING SET PIECES

(71) Applicant: Universal City Studios LLC, Universal City, CA (US)

(72) Inventor: Anthony Melo, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 17/465,400

(22) Filed: Sep. 2, 2021

(65) Prior Publication Data

US 2022/0134247 A1 May 5, 2022

Related U.S. Application Data

(60) Provisional application No. 63/108,759, filed on Nov. 2, 2020.

(51) Int. Cl.

| | |
|---|---|
| ***A63G 31/16*** | (2006.01) |
| ***A63G 31/02*** | (2006.01) |
| ***A63J 1/02*** | (2006.01) |
| *G03B 21/60* | (2014.01) |

(52) U.S. Cl.

CPC ..... *A63G 31/16* (2013.01); *A63G 31/02* (2013.01); *A63J 1/02* (2013.01); *A63J 2001/026* (2013.01)

(58) Field of Classification Search

CPC ..... A63G 31/00; A63G 31/02; A63G 31/16; G03B 21/60; G03B 21/56

USPC ..... 472/43, 59–61, 130

See application file for complete search history.

(56) References Cited

U.S. PATENT DOCUMENTS

| | | | | |
|---|---|---|---|---|
| 482,736 | A | 9/1892 | Hardy | |
| 7,572,166 | B2 | 8/2009 | Blum et al. | |
| 8,137,205 | B2 | 3/2012 | Cortelyou et al. | |
| 9,958,767 | B1 | 5/2018 | Reichow et al. | |
| 10,099,149 | B2 | 10/2018 | Boyle | |
| 10,133,171 | B2 | 11/2018 | Grundhofer et al. | |
| 10,525,364 | B2 | 1/2020 | Bluhm | |
| 2012/0149480 | A1 | 6/2012 | Crawford et al. | |
| 2021/0279893 | A1* | 9/2021 | Iwanowski | G06N 20/00 |

FOREIGN PATENT DOCUMENTS

| | | | |
|---|---|---|---|
| JP | 2000342858 | A | 12/2000 |

OTHER PUBLICATIONS

PCT/US2021/056675 International Search Report and Written Opinion dated Feb. 22, 2022.

* cited by examiner

*Primary Examiner* — Kien T Nguyen

(74) *Attorney, Agent, or Firm* — Fletcher Yoder, P.C.

(57) ABSTRACT

The present disclosure describes an amusement show system. The amusement show system includes guest seating, a background display, a conveyor, and a set piece disposed on the conveyor. The conveyor moves the set piece with respect to the guest seating between the guest seating and the background display. The amusement show system also includes a projection mapping system that includes one or more projectors configured to project images onto the set piece such that a first image is projected onto the set piece at a first point in time and a second image is projected onto the set piece at a second point in time.

20 Claims, 4 Drawing Sheets

DYNAMIC PROJECTION MAPPING FOR MORPHING SET PIECES

CROSS-REFERENCE TO RELATED APPLICATION

This application claims priority to and the benefit of U.S. Provisional Application No. 63/108,759, entitled "DYNAMIC PROJECTION MAPPING FOR MORPHING SET PIECES," filed Nov. 2, 2020, which is hereby incorporated by reference in its entirety for all purposes.

BACKGROUND

The present disclosure relates generally to amusement park attractions and, specifically, to projection mapping systems for an amusement park attraction.

This section is intended to introduce the reader to various aspects of art that may be related to various aspects of the present disclosure. This discussion is believed to be helpful in providing the reader with background information to facilitate a better understanding of the various aspects of the present disclosure. Accordingly, it should be noted that these statements are to be read in this light and not as admissions of prior art.

Amusement parks include various attractions that entertain guests. For example, an amusement park may have attractions including rides and shows to provide a desirable experience to guests. Some attractions use a lot of space and have a large real estate footprint in operation. For example, an attraction may include a ride vehicle travelling to multiple rooms during the attraction. As such, the attraction may be costly in real estate.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, an amusement show system is provided. The amusement show system includes guest seating, a background display, a conveyor, and a set piece disposed on the conveyor. The conveyor is configured to move the set piece, with respect to the guest seating, between the guest seating and the background display. The amusement show system also includes a projection mapping system that includes one or more projectors configured to project images onto the set piece such that a first image is projected onto the set piece at a first point in time and a second image is projected onto the set piece at a second point in time.

In an embodiment, a tangible, non-transitory, and machine-readable medium of an amusement show system is provided. The medium includes machine-readable instructions that, when executed by one or more processors of a machine, cause the machine to perform operations including controlling movement of an amusement ride vehicle, controlling a background display in coordination with the movement of the amusement ride vehicle, and controlling a conveyor to transition a set piece along the conveyor such that the set piece moves along the path between the amusement ride vehicle and the background display. The instructions, when executed by the one or more processors, also cause the machine to perform operations including controlling a projection mapping system that comprises one or more projectors to project images onto the set piece such that a first image is projected on the set piece at a first point in time and a second image is projected on the set piece at a second point in time.

In an embodiment, a method of providing an amusement show is disclosed. The method includes maneuvering an amusement ride vehicle, providing a dynamic background display in coordination with the maneuvering of the amusement ride vehicle, and transitioning a set piece along a conveyor such that the set piece moves along a path disposed between the amusement ride vehicle and the background display. The method also includes projecting images onto the set piece such that a first image is projected onto the set piece at a first point in time and a second image is projected onto the set piece at a second point in time.

In an embodiment, a tangible, non-transitory, and machine-readable medium is provided. The medium includes machine-readable instructions that, when executed by one or more processors of the machine, cause the machine to perform operations including receiving a first indication of a set piece of a plurality of set pieces configured to be utilized in an amusement show, identifying the set piece based on the first indication, determining a first image to project on the set piece, and causing the first image to be projected onto the set piece. The plurality of set pieces is disposed on a conveyor configured to transition the plurality of set pieces. The instructions also cause the machine to perform operations including receiving a second indication of the set piece, identifying the set piece based on the second indication, determining a second image to project onto the set piece, and causing the second image to be projected onto the set piece.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, in which.

DETAILED DESCRIPTION

Figure 1:
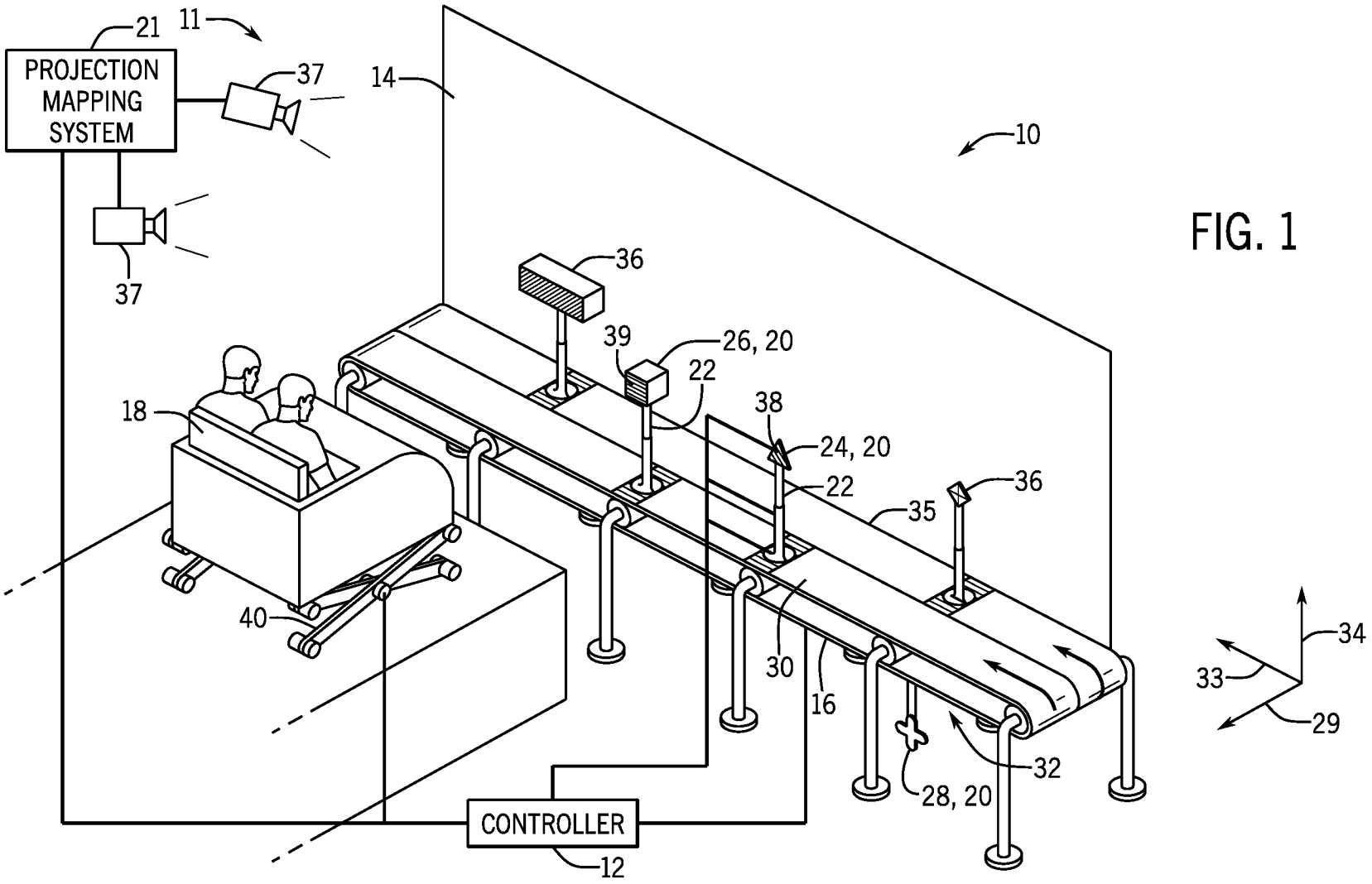
FIG. 1 is a perspective view of an amusement show system, in accordance with an embodiment of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the," are intended to mean that there are one or more of the elements. The terms "comprising," "including," and "having" are intended to be inclusive and mean that there may be additional elements other than the listed elements. One or more specific embodiments of the present embodiments described herein will be described below. In an effort to provide a concise description of these embodiments, all features of an actual implementation may not be described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

The following disclosure describes systems and methods for providing an amusement show system in accordance with present embodiments. The amusement show system may include guest seating (e.g., seating within a ride vehicle or theatre), a background display, a conveyor, and a set piece disposed on the conveyor. The conveyor may move the set piece with respect to the guest seating such that the set piece traverses a path between the guest seating and the background display. The set piece, which may include a dynamic structure (e.g., inflatable robotics), may be operable to transition between various geometric configurations. Numerous set pieces may be utilized, including static and dynamic set pieces. Further, the set pieces may be positioned along the conveyor (e.g., a conveyor belt) such that when a first group of set pieces are visible to guests in the seating, a second group of set pieces is hidden (e.g., on an underside or backside of the conveyor).

The amusement show system includes a projection mapping system with one or more projectors configured to project (projection map) images onto the set piece (or set pieces). The projection mapping system may operate to project a first image onto the set piece at a first point in time (e.g., when the set piece is in a first geometric configuration) and operate to project a second image onto the set piece at a second point in time (e.g., when the set piece is in a second geometric configuration). Thus, the same set piece may appear to be completely different objects at different points in time. This may include transitioning between geometries while the set piece is visible to guests or while it is concealed from the guests. By moving the set piece relative to the seating and transitioning an appearance of the set piece using one or both of projection mapping and adjustable geometric configuration, present embodiments may create an illusion of transition or movement for guests observing from the seating. For example, the set piece may appear to change size to suggest a change in perspective associated with relative movement or the set piece may appear as different objects at different points in time to suggest a transition between locations or settings (e.g., a picnic table in a first setting and a television set in a second setting). This illusion of transition or movement may be provided in conjunction with actual movement (e.g., movement of the seating) to create an impression of moving between areas or rooms while guests remain in the seating and do not traverse large areas of real estate. Thus, present embodiments may efficiently utilize real estate while also providing a ride experience that gives guests a feeling of substantial travel.

Projection mapping techniques that utilize object tracking or object identification methods for projecting images onto the set pieces of an amusement show system are also provided. In particular, the projection mapping techniques are provided for the set pieces, which may include both static set pieces and morphing set pieces. A projection mapping system may determine an image to project onto each set piece of the amusement show system based upon one or more tracking or identification techniques. For example, computer vision systems, position tracking systems, timing systems, and the like may be employed to track and/or identify location, geometric configuration, transition speed, and other parameters associated with the set piece to facilitate projection mapping onto the set piece. In one example, the projection mapping system may be coupled to an encoder values system that transmits data indicative of a rotation status of a conveyor of the amusement show system to facilitate identification of a location and/or geometric configuration of a particular set piece for projection targeting. Indeed, the parameters of the set piece detected by the tracking or identification techniques, such as parameters including location and geometric configuration of the set piece, may be a basis upon which the projection mapping system determines not only projection targeting parameters, but also projection content (e.g., an image of a first cartoon character for a first geometric configuration and a second cartoon character for a second geometric configuration).

Advantages of the described embodiments may include a reduction in an amount of space required to change sets in an amusement show. The techniques described may also allow guests to experience an illusion of movement across rooms into different physical sets without actually moving the guests to different sets. Indeed, using the techniques described herein, various contexts and locations may be simulated in a single room during an attraction experience, thus providing the illusion of movement across rooms or locations. Indeed, it may be desirable to reduce an amount of space necessary to change context provided in an amusement show due to limited availability of real estate. Other advantages may include set piece tracking in real time. Indeed, by utilizing a projection mapping system that utilizes object identification techniques, such as computer vision system techniques or object position tracking techniques (e.g., scanning encoded values), interactive attractions can change context or media in real time.

Turning to the drawings, FIG. 1 is a perspective view of an amusement show system 10 in a room 11, in accordance with an embodiment of the present disclosure. The amusement show system 10 includes a controller 12, a background display 14 (e.g., a display panel, a projection screen), a conveyor 16 (e.g., a conveyor belt, a cyclic conveyor belt) positioned between guesting seating 18 and the background display 14, a plurality of set pieces 20 disposed on the conveyor 16, and a projection mapping system 21 that projects images onto the plurality of set pieces 20. While particular set pieces may be directly coupled to the conveyor 16, each set piece of the plurality of set pieces 20 in FIG. 1 is coupled to the conveyor 16 via an extender 22 that, among other things, holds or anchors the set piece to the conveyor 16. The illustrated embodiment shows the plurality of set pieces 20 including a first set piece 24, a second set piece 26, and third set piece 28 disposed on the conveyor 16.

Each set piece of the plurality of set pieces 20 is configured to move along the conveyor 16 relative to the guest seating 18. The conveyor 16 rotates about an axis parallel to an axis 29. The conveyor 16 in the illustrated embodiment includes a conveyor belt with a top portion 30 (e.g., visible portion) and a bottom portion 32 (e.g., hidden portion). Guests in the guest seating 18 can observe a particular set piece of the set pieces when the particular set piece is located on the top portion 30 of the conveyor 16. The guest in the guest seating 18 may not be able to observe the particular set piece while the particular set piece is located on the bottom portion 32 of the conveyor 16. In FIG. 1, the first set piece 24 and the second set piece 26 are depicted as located on the top portion 30 of the conveyor 16 and the third set piece 28 (e.g., in a deflated geometric configuration) is depicted as located on the bottom portion of the conveyor 16. The first set piece 24 and the second set piece 26 are illustrated as moving parallel to an axis 33 on the top portion 30 of the conveyor 16. The first set piece 24 and the second set piece 26 are positioned at different heights parallel to an axis 34. It should be noted that the third set piece 28, while illustrated as extending downward from the conveyor 16, may be positioned flush to the conveyor 16 to facilitate avoidance of collision with other features in accordance with an embodiment. For example, the plurality of set pieces 20 may be designed to collapse (e.g., via a hinging action) when transitioning to or on the hidden portion of the conveyor 16, which may allow for a limited height of the conveyor 16. Also, in other embodiments, the conveyor 16 may be positioned in different orientations (e.g., such that a surface of the conveyor 16 faces the guest seating 18 and blocks guests in the guest seating 18 from viewing an opposing side of the conveyor 16).

While some embodiments may include only a single conveyor (e.g., conveyor 16), in the illustrated embodiment, an additional conveyor 35 is installed between the guest seating 18 and the background display 14. The additional conveyor 35 is located at a different depth (e.g., closer to the background display 14) than the conveyor 16 relative to the guest seating 18. In other embodiments, additional conveyors, including conveyors running in different directions, may also be included. For example, in an embodiment, an additional conveyor may be installed above the guest seating 18 (e.g., near the top of the background display 14) such that is runs parallel to the conveyor 16 (or in another direction). By utilizing multiple conveyors 16, 35 in this manner, present embodiments may provide additional effects to provide immersion in a scene. For example, an additional plurality of set pieces 36 may include miniature structures that represent background features (e.g., trees) and the additional conveyor 35 may move the additional plurality of set pieces 36 slower relative to the plurality of set pieces 20 on the conveyor 16 to create an illusion of depth and movement.

The additional conveyor 35 and the additional plurality of set pieces 36 disposed on the additional conveyor 35 are representative of any of various additional conveyors and set pieces. It should be noted that the additional conveyor 35 and the additional plurality of set pieces 36 (and other conveyors and set pieces) may generally have similar capabilities to those of the conveyor 16 and the plurality of set pieces 20. As such, to facilitate efficient discussion, it should be understood that disclosed functionality of the conveyor 16 and the plurality of set pieces 20 is applicable to the additional conveyor 35 and the additional plurality of set pieces 36. That is, it should be understood that general functionality attributed to the conveyor 16 and the plurality of set pieces 20 is applicable to the various other conveyors that could be employed.

Each set piece of the plurality of set pieces 20 of the amusement show system 10 may be projection mapped by the projection mapping system 21. This may include detecting (e.g., via an image or depth sensor, such as a camera) or using predefined geometric data (e.g., coordinates or contours) to project imagery onto the plurality of set pieces 20 to create an illusion of texture, depth, color, shape, and so forth. The projection mapping system 21 includes one or more projectors 37 projecting images (e.g., patterns, shapes, textures, graphic features, animations, video content), onto the plurality of set pieces 20 on the visible portion (e.g., top portion 30) of the conveyor 16. In the illustrated embodiment, the first set piece 24 has a first image 38 projected thereon by the projection mapping system 21 and the second set piece 26 has a second image 39 projected thereon by the projection mapping system 21. The first image 38 and the second image 39 may be similar images or different images. The first image 38 may be projected onto the first set piece 24 at a first point in time and the image 39 may be projected onto the second set piece 26 at the first point in time. The first and second images 38, 39 (e.g., projected images) provided on the first and second set pieces 24, 26 may change throughout a show given by the amusement show system 10. As should be understood, these first and second images 38, 39 may cause the first and second set pieces 24, 26 to appear as any of various different things and may coordinate with physical aspects (e.g., a geometric shape) of the first and second set pieces 24, 26 to increase immersion in the illusion provided by the first and second images 38, 39.

In the illustrated embodiment, the amusement show system 10 includes the guest seating 18 (e.g., seating in an amusement ride vehicle) arranged on a motion base 40. The motion base 40 can cause the guest seating 18 (and corresponding guests occupying the guest seating 18) to move in roll, pitch, heave, yaw, sway, and surge directions. For example, the guest seating 18 may be controlled by a hydraulics system in coordination with the context of the room 11 provided by the amusement show system 10 (e.g., via projections on the background display 14 and on the plurality of set pieces 20). In this way, the motion base 40 can provide guests occupying the guest seating 18 with a physical effect (e.g., vibration, jerk motion) in coordination with a setting given by the amusement show system 10. For example, as the conveyor 16 moves the plurality of set pieces 20 in a first direction, the motion base 40 may move the guest seating 18 in an opposite direction to increase a perception of movement based on contextual changes while also giving the guests a feeling of actual movement.

In the illustrated embodiment, the controller 12 is communicatively coupled to various components of the amusement show system 10 (via one or more wired or wireless communication media). The controller 12 may include one or more processors and one or more computer-readable memories that include instructions that may be executed by the one or more processors. The instructions may include instructions or commands to cause various features of the amusement show system 10, such as the motion base 40, the plurality of set pieces 20 the projection mapping system 21, and the conveyor 16 to operate in sync with each other to create an illusion of transitioning between environments. For example, the controller 12 can be configured to coordinate media displayed on the background display 14 with movement of the conveyor 16 to create an illusion of transitioning between environments.

Figure 2:
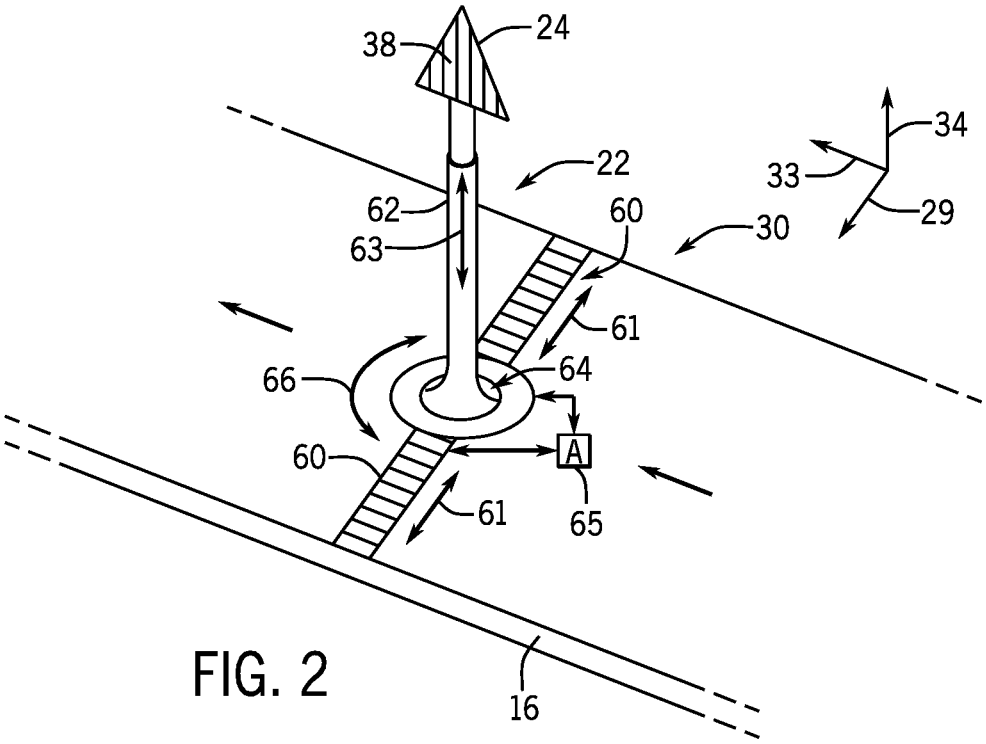
FIG. 2 is a schematic perspective view of a set piece on a conveyor of the amusement show system of FIG. 1, in accordance with an embodiment of the present disclosure.

FIG. 2 provides a closer view of the first set piece 24 of the amusement show system 10 of FIG. 1 and its extender 22. The first set piece 24 is coupled to the extender 22 on the conveyor 16. The illustrated extender 22 includes various features that allow the first set piece 24 to move relative to the conveyor 16. For example, in the depicted embodiment, the extender 22 includes a rail 60. The rail 60, in cooperation with an actuator or driver 65, causes the first set piece 24 to move parallel to the axis 29 (as indicated by the arrows 61). In this way, when motion along the rail 60 is activated (e.g., enabled via one or more control signals), the first set piece 24 may be moved to a position closer or further from the background display 14 of FIG. 1 (and similarly further from or closer to the guest seating 18 of FIG. 1), thus allowing the amusement show system 10 of FIG. 1 to control a depth at which the first set piece 24 is positioned. In some embodiments, the rail 60 may be installed to cause the first set piece 24 to move along other directions.

In the depicted embodiment, the extender 22 includes a telescoping arm 62 that may be actuated to translate the first set piece 24. The telescoping arm 62 may cause the first set piece 24 to move up or down parallel to the axis 34 (as indicated by the arrow 63). In the depicted embodiment, the extender 22 also includes a pivot joint 64 that, upon actuation, may cause the first set piece 24 to rotate about the pivot joint 64 (e.g., an anchored position on the conveyor 16). For example, the rotation about the pivot joint 64 may include a rotation about an axis parallel to the axis 34 (as indicated by the arrow 66) or a rotation about any axis perpendicular to the axis 34 such as the axis 29 and the axis 33 (e.g., following an arc-motion), or a combination thereof. One or more of features of the extender 22 illustrated in FIG. 2 may be included in one or more extenders 22 coupled to the plurality of set pieces 20 of the amusement show system 10 of FIG. 1. It should be noted that each extender 22 may be actuated independently of other extenders 22 on the conveyor 16. For example, the first set piece 24 may move parallel to the axis 29 to a position closer to the guest seating 18, while the second set piece 26 may remain at a particular position or move parallel (e.g., anti-parallel) to the axis 29 to a backwards position further from the guest seating 18. In other embodiments, the some or all of the extenders 22 employed on the conveyor 16 may be coupled to each other such as via one or more motors (e.g., actuators). The extender 22 may take other forms a well. For example, the extender 22 may include a series of telescoping sections (in various directions), a hydraulic cylinder, an inflatable extension, a screw-type extender, hinged sections that actuate to expand, an accordion-type extender, and so forth.

During an amusement show, the amusement show system 10 of FIG. 1 may cause one or more set pieces of the plurality of set pieces 20 to change shape. Indeed, a feature provided by the amusement show system 10 is the dynamic changing of contexts by "recycling" set pieces. The plurality of set pieces 20 are not only recycled in that they alternate locations among the top portion 30 and the bottom portion 32 of the conveyor 16, but also, in that the set pieces 20 can change geometric configurations. In particular, some of the plurality of set pieces 20 disposed on the conveyor 16 can change shape at one or more times or time durations during a show given by the amusement show system 10. A set piece of the plurality of set pieces 20 may include any of various morphing mechanisms that allow the shape (e.g., geometric configuration) of the set piece to change. For example, a servo motor or a pneumatic actuator, or a combination thereof, may be included in or coupled to the first set piece 24. As such, the servo motor or pneumatic actuator, or the combination thereof, may maneuver structural features of the set piece to cause the set piece the change geometric configurations. The plurality of set pieces 20 may include similar or different types of set pieces having similar or different structures for changing one or more geometric characteristics of particular set pieces. For example, one or more of the set pieces of the plurality of set pieces 20 disposed on the conveyor 16 may be soft robots. In some embodiments, the plurality of set pieces 20 disposed on the conveyor 16 includes fixed geometry set pieces and modifiable geometry set pieces. It should be noted that the shape of a particular set piece may change relative to a view of the particular set piece from the guest seating 18 (e.g., anti-parallel to the axis 29). Such a shape change can occur via an extender 22 coupled to the particular set piece. For example, the pivot joint 64 of FIG. 2 may cause the first set piece 24 to rotate about the pivot joint 64 (e.g., about the axis 34), potentially causing the first set piece 24 to have a different shape relative to the guest seating 18 of FIG. 1 before the rotation occurs, which may allow for a different projection mapping and a completely different perception of the first set piece 24. As another example, a set piece may be a square having an image representing a store projected thereon at a first point in time, and then the same set piece may, after rotating, become a rectangular prism having an object indicating a fire truck projected thereon at a second point in time. In some embodiments, the absolute dimensions of the set piece may remain the same while the relative orientation and relative dimensions based on a view from the guest seating 18 may change, giving an illusion to a guest in the guest seating 18 that the real object (i.e., the set piece) is a different set piece than previously observed due to the change in observed geometry.

Figure 3:
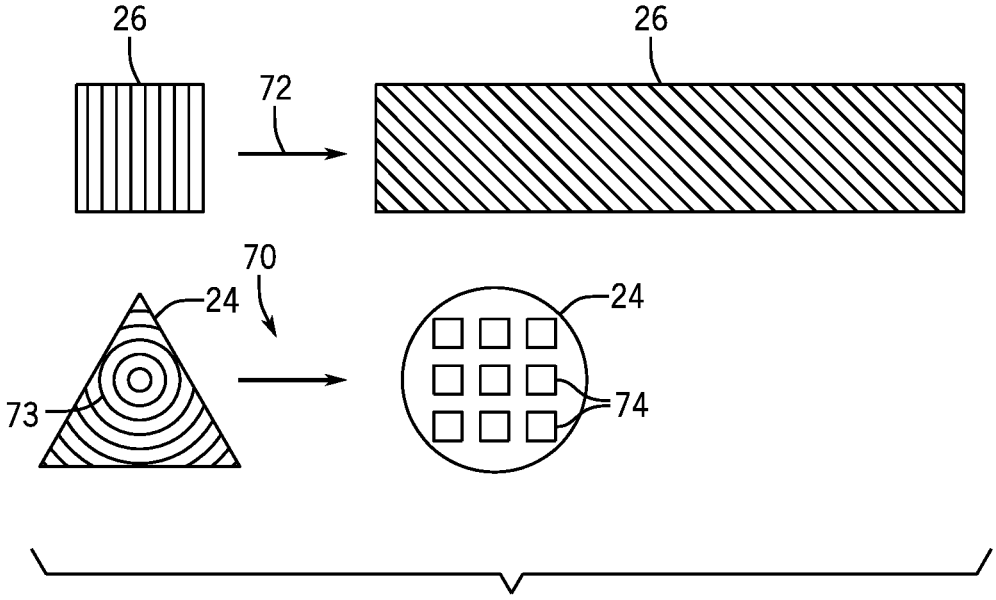
FIG. 3 is a diagram of example geometric transformations that set pieces of the amusement show system of FIG. 1 may configure to undergo, in accordance with an embodiment of the present disclosure.

FIG. 3 is a diagram of example geometric transformations that set pieces of the amusement show system 10 of FIG. 1 may undergo, in accordance with an embodiment of the present disclosure. In a first transformation 70, the first set piece 24 begins with a first set of geometric features that gives the first set piece 24 a shape of a triangle relative to the guest seating 18. The first set piece 24 may have the first set of geometric features when the first set piece 24 is on the top portion 30 of the conveyor 16 at a first point in time. At a second point in time in which the first set piece 24 is on the top portion 30 of the conveyor 16, the first set piece 24 has a second set of geometric features that gives the first set piece 24 a shape of a circle relative to the guest seating 18 of FIG. 1. In a second transformation 72, the second set piece 26 begins with a first set of geometric features that gives the second set piece 26 a shape of a square relative to the guest seating 18. The second set piece 26 may have the first set of geometric features when the second set piece 26 is on the top portion 30 of the conveyor 16 at a first point in time. At a second point in time, the second set piece 26 has a second set of geometric features that gives the second set piece 26 a shape of a rectangle relative to the guest seating 18. The second set piece 26 may have the second set of geometric features when the second set piece 26 is on the top portion 30 of the conveyor 16 at the second point in time. In some cases, the first set piece 24 or the second set piece 26 may undergo the respective first or second transformation 70, 72 of relative or absolute shape while the respective set piece is in the bottom portion 32 of the conveyor 16 of the amusement show system 10 of FIG. 1. In other cases, the first set piece 24 or the second set piece 26 may undergo the respective first or second transformation 70, 72 of relative or absolute shape while the respective set piece is in the top portion 30 of the conveyor 16 of the amusement show system 10 of FIG. 1.

As illustrated in FIG. 3, the first set piece 24 has a first image (e.g., a circle pattern) 73 projected thereon by the projection mapping system 21 of FIG. 1 when the first set piece 24 has a first shape or set of geometric characteristics at the first point in time. The first set piece 24 then has a second image (e.g., a pattern of squares) 74 projected thereon by the projection mapping system 21 of FIG. 1 when the first set piece 24 has a second shape or set of geometric characteristics at the second point in time. The projection mapping system 21 may project the first image 73 in coordination with the first geometric configuration at the first point in time and then project the second image with second image characteristics in coordination with the second geometric configuration at the second point in time. The transformation of the second set piece 26 in FIG. 3 illustrates a similar change as noted above with regard to the first set piece 24. Also, as will be discussed later with regard to FIG. 4, the projection mapping system 21 of FIG. 1 can project images onto the set pieces based on characteristics such as a shape of the set pieces.

Figure 4:
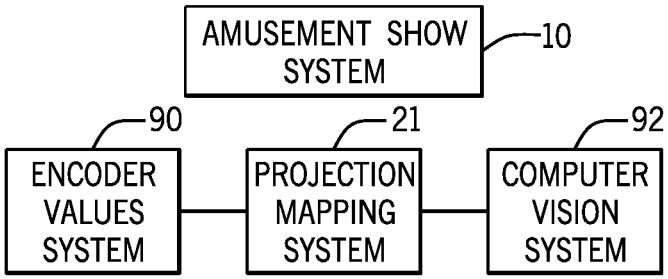
FIG. 4 is block diagram of a projection mapping system of the amusement show system of FIG. 1 coupled to various set piece tracking systems, in accordance with an embodiment of the present disclosure.

Various systems may be utilized by the projection mapping system 21 of FIG. 1 to project, onto each set piece, a specific image. For example, projection mapping may be programmed and timed for a particular show or the projection mapping can be performed in real time. FIG. 4 is block diagram of the projection mapping system 21 of the amusement show system 10 utilizing various set piece tracking systems to determine specific images to project onto specific set pieces, in accordance with an embodiment of the present disclosure. In the illustrated embodiment, the projection mapping system 21 is coupled to an encoder values system 90 and a computer vision system 92.

The encoder values system 90 may be part of or coupled to the conveyor 16 of the amusement show system 10. The encoder values system 90 may transmit (via any suitable wireless or wired medium), to the projection mapping system 21, encoder values indicative of a current rotation of the conveyor 16. For example, the encoder values system 90 may convert an angular position of a component of the conveyor 16 (e.g., a shaft or axle) to computer-readable signals or the encoder values system 90 may read barcode disposed on a moving portion of the conveyor 16 to determine positioning. Certain detected aspects (e.g., angular position or configuration based on detected data, such as a bar code) can be correlated to locations of set pieces. As a specific example, when a particular bar code on a conveyor belt is scanned by a fixed barcode reader, it may be established (e.g., based on an algorithm or lookup table) that a particular set piece is in a particular position. Based on the input received from the encoder values system 90, the projection mapping system 21 may determine one or more images to project onto set pieces of the plurality of set pieces 20 of the amusement show system 10. As an example, the encoder values system 90 may include an encoder that generates an indication of a first position of the first set piece 24. The projection mapping system 21 may receive the generated indication and assemble (e.g., based on an algorithm or lookup table) characteristics of an image to project onto the first set piece 24 based on the generated indication.

In FIG. 4, the projection mapping system 21 is also coupled to the computer vision system 92. In other embodiments, only one of the projection mapping system 21, the encoder values system 90, or some other position detection system may be employed. The computer vision system 92 may employ various computer vision-based tracking systems such as infrared light (IR) markers and other objection recognition techniques. For example, IR markers may be disposed on the extenders 22, the plurality of set pieces 20, or the conveyor 16, and may flash IR light at various frequencies specific to each set piece of the plurality of set pieces 20. Based on the frequency of flashing of the IR light, the projection mapping system 21 may identify a set piece and determine an image or a plurality of images to project onto the set piece. As another example, the computer vision system 92 may include one or more cameras (e.g., a light detection and ranging cameras) that are configured to detect shapes of set pieces and use such detected shapes with the projection mapping system 21 to provide essentially real-time projection mapping output. The computer vision system 92 may include circuitry to transmit, to the projection mapping system 21, geometric values (e.g., encoded in computer-readable signals) indicative of a shape of a set piece as detected from the shape itself or based on encoded data (e.g., a QR CODE). Based on the shape, the projection mapping system 21 may determine an image to project onto the set piece.

Figure 5:
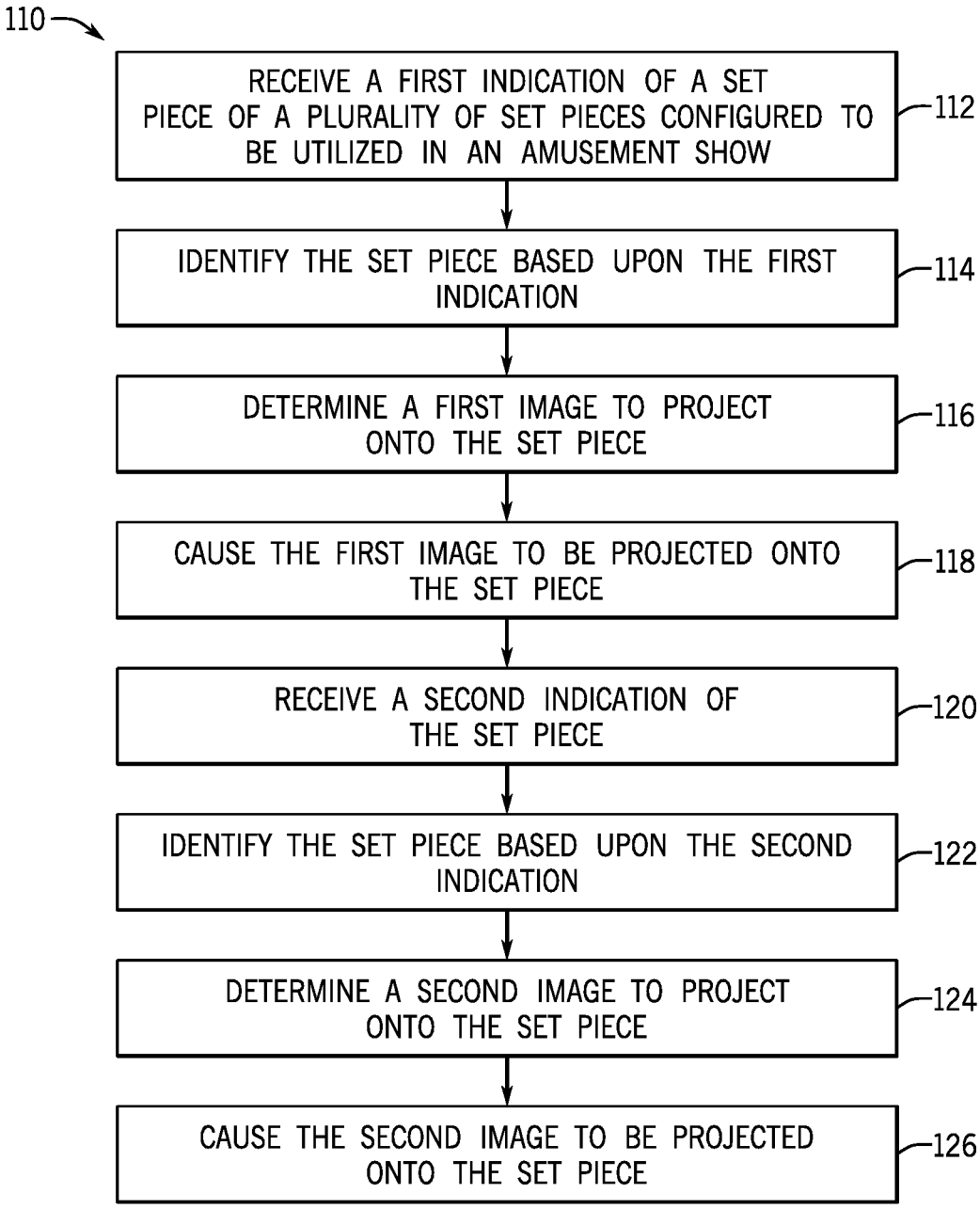
FIG. 5 is an example process for projecting images onto set pieces of the amusement show system of FIG. 1.

FIG. 5 illustrates a method 110 that may be utilized by the projection mapping system 21, in accordance with an embodiment of the present disclosure. The method 110 may be performed by one or more processors of the projection mapping system 21. One or more steps of the method 110 may be stored in machine-readable instructions on one or more tangible, non-transitory, and machine-readable media. Also, the steps of the method 110 may be performed in any suitable order.

The method 110 begins with receiving (block 112) a first indication of a set piece of a plurality of set pieces configured to be utilized in an amusement show. The first indication may have been transmitted from a computer vision system that detects flash frequencies of IR light emitting from the set piece. Indeed, an IR marker may be coupled to the set piece and may emit IR light at a specific frequency specific to the set piece. In other embodiments, other indications may be received (e.g., a detected shape based on data from a light detection and ranging camera).

The method 110 proceeds to identifying (block 114) the set piece based upon the first indication. For example, in response to detecting a particular frequency of emitted IR light detected from the set piece, a mapping of IR flash frequencies to specific set pieces of the plurality of set pieces may be consulted. Based on the mapping, the set piece may be identified. As another example, the set piece may be identified via a computer vision system that may transmit values indicative of shape or the geometric configuration of the set piece.

The method 110 proceeds to determining (block 116) a first image to project onto the set piece. For example, in response to identifying the set piece, a schedule may be consulted to determine a specific image to project onto the set piece at a particular time during an amusement show or based on a particular type of detected set piece or set piece configuration. Once the first image is determined, the method 110 proceeds to causing (block 118) the first image to be projected onto the set piece. For example, a signal may be transmitted to a projector of the projection mapping system 21 of FIG. 1 to project the first image onto the set piece.

The method 110 proceeds to receiving (block 120) a second indication of the set piece. For example, the second indication may be received when the set piece has completed a full cycle of a conveyor and is again near a top portion or viewable portion of a conveyor on which the set piece is disposed. The first indication and the second indication may include indications from similar or different set piece tracking systems as discussed with regard to FIG. 4. For example, the first indication may be transmitted to the projection mapping system 21 by the encoder values system 90 of FIG. 4 and the second indication may be transmitted to the projection mapping system 21 by the computer vision system 92 of FIG. 4. Next, the method 110 proceeds to identifying (block 122) the set piece based upon the second indication and determining (block 124) a second image to project onto the set piece. For example, in response to identifying the set piece based on the second indication, the schedule may be consulted again to determine a specific image to project onto the set piece at a specific time during an amusement show. The method 110 then proceeds to causing (block 126) a second image to be projected onto the set piece. For example, a signal may be transmitted to a projector of the projection mapping system 21 to activate specific lighting features to project the second image onto the set piece.

Figure 6:
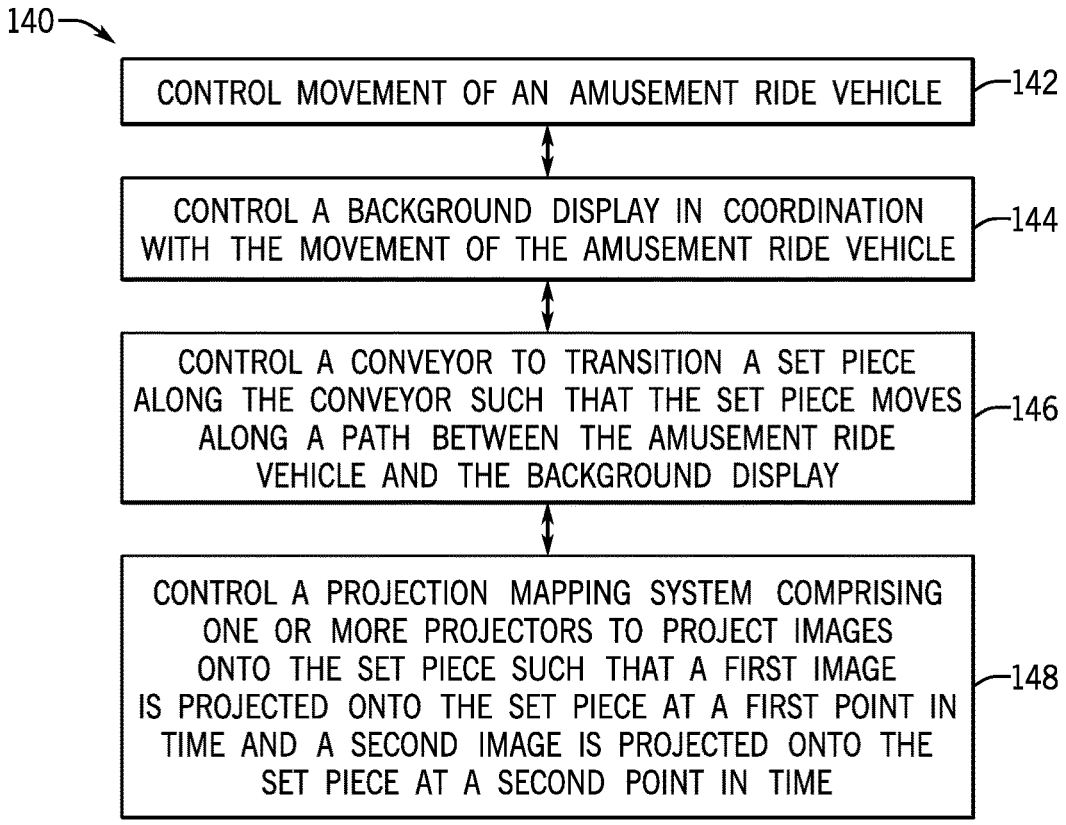
FIG. 6 is an example process for controlling aspects of the amusement show system of FIG. 1, in accordance with an embodiment of the present disclosure.

FIG. 6 illustrates a method 140 for controlling aspects of the amusement show system 10 of FIG. 1, in accordance with an embodiment of the present disclosure. One or more steps of the method 140 may be stored in machine-readable instructions on one or more tangible, non-transitory, and machine-readable media. The machine-readable instructions may be executed by one or more processors of a machine, and as such, upon execution, one or more steps of the method 140 may be performed. It should be noted that the method may be performed in any suitable order. It should also be noted that the instructions may be executed by one or more processors of multiple machines that operate together to provide the amusement show system 10.

The method 140 includes controlling (block 142) movement of an amusement ride vehicle (e.g., the guest seating 18 of FIG. 1). The movement of the amusement ride vehicle may be movement directed by a motion base. The method 140 includes controlling (block 144) a background display in coordination with the movement of the amusement ride vehicle. Controlling the background display may include projecting or otherwise displaying objects on the background display. By controlling the background display in coordination with the movement of the amusement ride vehicle, guests in the amusement ride vehicle may experience physical effects in coordination with a context displayed on the background display.

The method 140 includes controlling (block 146) a conveyor to transition a set piece, which may be one of a number of set pieces, along the conveyor such that the set piece moves along the path between the amusement ride vehicle and the background display. In some embodiments, block 146 may include controlling multiple conveyors that cause movement of multiple set pieces along multiple different paths relative to the guest seating. The conveyor may be controlled to move at a specific angular velocity. In addition, in some embodiments, the method 140 may include controlling the conveyor to cycle the set piece from a top portion of the conveyor to a bottom portion of the conveyor.

The method 140 includes controlling (block 148) a projection mapping system that includes one or more projectors that project images onto the set piece such that a first image is projected onto the set piece at a first point in time and a second image is projected onto the set piece at a second point in time. This may include providing animation, adjusting projections for changing shapes and positions of the set pieces, coordinating projected images with movement of the guest seating, coordinating with projected images provided on the background display, and so forth.

In some embodiments, the method 140 includes controlling actuators of the set piece to transition the set piece from a first geometric configuration to a second geometric configuration. For example, the set piece may include inflatable robotics and actuators may provide or remove air from a diaphragm of the set piece to change an overall shape of the set piece. The actuators may actuate the set piece to transition from the first geometric configuration to the second geometric configuration while the set piece is in a hidden position. The hidden position may be a position in which a guest in the guest seating 18 may not see the set piece.

Figure 7:
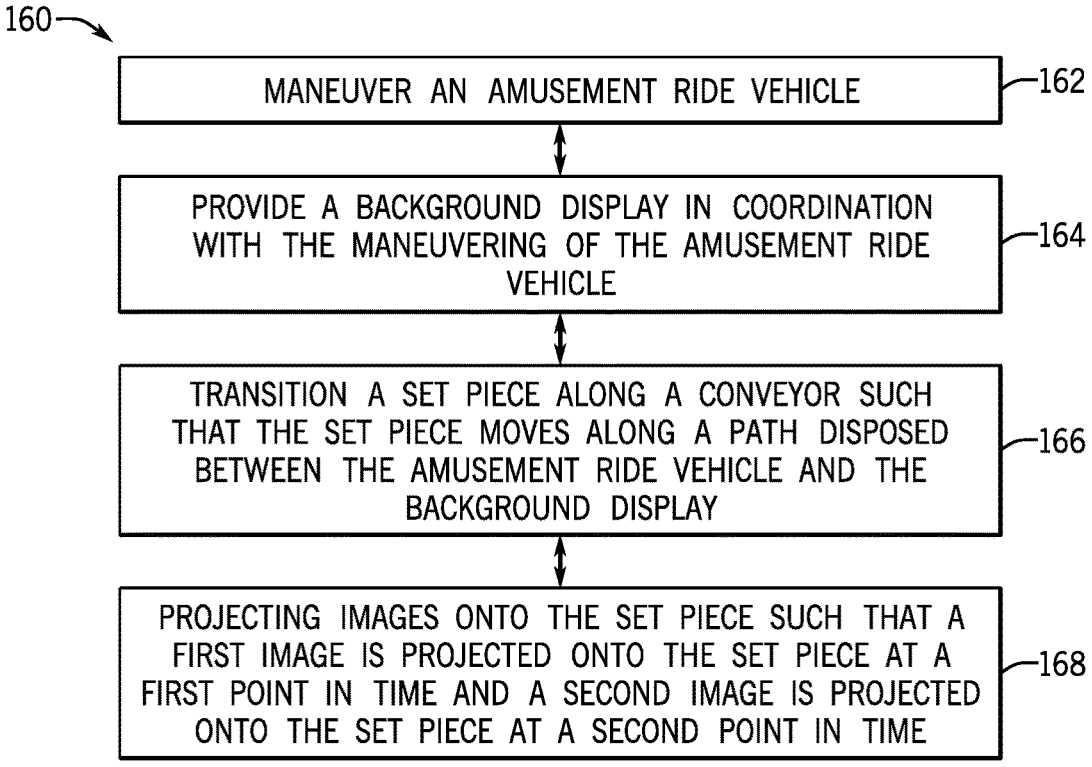
FIG. 7 is an example process for providing an amusement show, in accordance with an embodiment of the present disclosure.

FIG. 7 is a method 160 for providing an amusement show, in accordance with an embodiment of the present disclosure. The method 160 may be performed by one or more processors of a computing system. The method 160 may also be performed by one or more components of the amusement show system 10 of FIG. 1. The method 160 includes maneuvering (block 162) an amusement ride vehicle, which may include instructions to move the amusement ride vehicle and/or actual repositioning of the amusement ride vehicle. The amusement ride vehicle may be maneuvered via a motion base or another suitable mechanism based on instructions from a controller.

The method 160 includes providing (block 164) a background display in coordination with the maneuvering of the amusement ride vehicle. For example, one or more projectors may project or otherwise provide a background display illustrating an accelerating spaceship. The amusement ride vehicle may be maneuvered to induce one or more physical effects (e.g., vibratory effects, accelerations) that simulate the accelerating spaceship illustrated in the background display. This provides guests in the amusement ride vehicle with a physical experience as if they were on the accelerating space ship.

The method 160 also includes transitioning (block 166) a set piece along a conveyor such that the set piece moves along a path disposed between the amusement ride vehicle and the background display. For example, a set piece having an octagonal shape may be moved about the path. Images may be projected (block 168) onto the set piece such that a first image (e.g., projected image) is projected on the set piece at a first point in time and a second image is projected on the set piece at a second point in time. Returning to the example above, the set piece having the octagonal shape may receive a projected object indicative of a stop sign. For example, the projection mapping may include projecting a red background with the white letters indicating the word "STOP".

The set piece may continually rotate on the conveyor in coordination with the context given by the background display. At a different point in time, the set piece may have a different image with different image characteristics (e.g., a different color, texture, contour, intensity, contrast). In some embodiments, the method 160 includes actuating features of the set piece to transition the set piece between at least two shapes (e.g., geometric configurations). In these embodiments, the set piece may be moved (e.g., along a rail) relative to a conveyor that is moving the set piece relative to the amusement ride vehicle. For example, in some embodiments, the method 160 includes actuating an extender (e.g., an extender 22 of the amusement show system 10 of FIG. 1) to move the set piece relative to the conveyor while the set piece is moving between the amusement ride vehicle and the background display.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An amusement show system comprising:

guest seating;

a background display;

a conveyor;

a set piece disposed on the conveyor, wherein the conveyor is configured to move the set piece with respect to the guest seating between the guest seating and the background display; and a projection mapping system comprising one or more projectors configured to project images onto the set piece such that a first image is projected onto the set piece at a first point in time and a second image is projected onto the set piece at a second point in time.

2. The amusement show system of claim 1, comprising a ride vehicle including the guest seating and a motion base configured to move the ride vehicle.

3. The amusement show system of claim 1, comprising an extender coupled to the set piece and configured to be actuated to maneuver the set piece relative to the conveyor.

4. The amusement show system of claim 3, wherein the extender comprises a rail along which the set piece is configured to travel, a telescoping arm configured to be actuated to translate the set piece, a pivot joint configured to rotate the set piece, or a combination thereof.

5. The amusement show system of claim 1, wherein the set piece is configured to morph between geometric configurations.

6. The amusement show system of claim 5, wherein the set piece comprises a soft robot.

7. The amusement show system of claim 5, comprising a servo motor, pneumatic actuator, or a combination thereof, configured to maneuver structural features of the set piece to change between the geometric configurations.

8. The amusement show system of claim 1, comprising a plurality of set pieces disposed on the conveyor wherein the plurality of set pieces include at least fixed geometry set pieces or modifiable geometry set pieces.

9. The amusement show system of claim 1, wherein the conveyor comprises a cyclic conveyor belt configured to cycle the set piece between a visible portion of the cyclic conveyor belt and a hidden portion of the cyclic conveyor belt, wherein the set piece is configured to transition from a first geometric configuration to a second geometric configuration while traveling along the hidden portion.

10. The amusement show system of claim 9, wherein the projection mapping system is configured to project the first image with first image characteristics in coordination with the first geometric configuration at the first point in time and the second image with second image characteristics in coordination with the second geometric configuration at the second point in time.

11. The amusement show system of claim 1, comprising an additional conveyor disposed between the conveyor and the guest seating, the additional conveyor having a plurality of second set pieces disposed thereon and configured to move the plurality of second set pieces relative to the guest seating and the conveyor.

12. The amusement show system of claim 11, comprising a controller, wherein the background display comprises a projection screen, and wherein and the controller is configured to coordinate media displayed on the projection screen with movement of the conveyor to create an illusion of transitioning between environments.

13. The amusement show system of claim 1, comprising an encoder configured to generate an indication of a first position of the set piece, wherein the projection mapping system is configured to receive the indication and assemble characteristics of the first image based on the indication.

14. The amusement show system of claim 1, comprising an additional set piece on an opposite side of the conveyor from the set piece such that the additional set piece is visible on the conveyor when the set piece is hidden.

15. A tangible, non-transitory, and machine-readable medium of an amusement show system, the tangible, non-transitory, and machine-readable medium comprising machine-readable instructions that, when executed by one or more processors of a machine, cause the machine to:

control movement of an amusement ride vehicle;

control a background display in coordination with the movement of the amusement ride vehicle;

control a conveyor to transition a set piece along the conveyor such that the set piece moves along a path between the amusement ride vehicle and the background display; and control a projection mapping system comprising one or more projectors to project images onto the set piece such that a first image is projected onto the set piece at a first point in time and a second image is projected onto the set piece at a second point in time.

16. The tangible, non-transitory, and machine-readable medium of claim 15, wherein the machine-readable instructions, when executed by the one or more processors, cause the machine to control actuators of the set piece to transition the set piece from a first geometric configuration to a second geometric configuration.

17. The tangible, non-transitory, and machine-readable medium of claim 15, wherein the machine-readable instructions, when executed by the one or more processors, cause the machine to control the conveyor to cycle the set piece from a viewable position to a hidden position between the first point in time and the second point in time.

18. A method of providing an amusement show, the method comprising:

maneuvering an amusement ride vehicle;

providing a background display in coordination with the maneuvering of the amusement ride vehicle;

transitioning a set piece along a conveyor such that the set piece moves along a path disposed between the amusement ride vehicle and the background display; and projecting images onto the set piece such that a first image is projected onto the set piece at a first point in time and a second image is projected onto the set piece at a second point in time.

19. The method of claim 18, comprising actuating features of the set piece to transition the set piece between at least two geometric configurations.

20. The method of claim 18, comprising actuating an extender to move the set piece relative to the conveyor while the set piece is moving between the amusement ride vehicle and the background display.

* * * * *